US005735756A

United States Patent [19]

Stiefel et al.

[11] Patent Number: 5,735,756

[45] Date of Patent: Apr. 7, 1998

[54] GOLF BALL AND DIMPLE PATTERN FORMING PROCESS

[75] Inventors: Joseph F. Stiefel, Ludlow; Gary Tavares, Starbridge, both of Mass.

[73] Assignee: Lisco, Inc., Tampa, Fla.

[21] Appl. No.: 711,488

[22] Filed: Sep. 10, 1996

[51] Int. Cl.[6] ..... A63B 37/14

[52] U.S. Cl. ..... 473/382; 473/384

[58] Field of Search ..... 473/378, 382, 473/383, 384, 409

[56] References Cited

U.S. PATENT DOCUMENTS 5,441,276 8/1995 Lim ..... 473/378

*Primary Examiner*—George J. Marlo

*Attorney, Agent, or Firm*—Donald R. Bahr; Laubscher & Laubscher

[57] ABSTRACT

A golf ball having an octahedral pattern about its surface with four identical quadrants in each hemisphere. Each quadrant includes a circular area which fills the quadrant as completely as possible without crossing the quadrant boundaries. A dimple is located at each pole. Each circular area is substantially filled with dimples and the remaining interstitial areas between the circular areas and the poles are substantially filled with dimples while leaving a dimple free equatorial line.

9 Claims, 3 Drawing Sheets

GOLF BALL AND DIMPLE PATTERN FORMING PROCESS

BRIEF DESCRIPTION OF THE INVENTION

This invention relates generally to golf balls and more particularly to the arrangement of dimples on a golf ball and the method for arranging such dimples.

Dimples are used on golf bails as a standard means for controlling and improving the flight of the golf ball. One of the basic criteria for the use of dimples is to attempt to cover the maximum surface of the ball with dimples without incurring any detrimental effects which would influence the aerodynamic symmetry of the ball. Such aerodynamic symmetry is necessary in order to satisfy the requirements of the United States Golf Association (U.S.G.A.). Aerodynamic symmetry means that the ball must fly substantially the same with little variation no matter how it is placed on the tee or on the ground.

In British Patent Provisional Specification Serial No. 377,354, filed May 22, 1931, in the name of John Vernon Pugh, there is disclosed various triangular configurations which may be used to establish dimple patterns that are geometrical and which would also be aerodynamically symmetrical. Pugh uses a number of geometrical patterns wherein he inscribes a regular polyhedron of various types in order to provide such symmetry. The details of plotting and locating the dimples is described in the above-mentioned provisional specification.

The problem arises with the Pugh icosahedral golf ball in that there is no equatorial line on the ball which does not pass through some of the dimples. Since golf balls are molded and manufactured by two hemispherical half molds normally having straight edges, the bail as it comes from the mold has a flash line about the equatorial line created by the two hemispheres of the mold. Even if the ball could be molded with dimples on the flash line, the ball could not be properly cleaned and finished in any efficient manner since the flash could not be cleaned from the bottom of the dimple without individual treatment of each dimple.

Many proposals have been made and, in fact, many balls have been produced using modifications of the Pugh polyhedron concept, which leave an equatorial dimple-free line and still substantially maintain aerodynamic symmetry.

Other various proposals have been made and balls have been conformed which use differing means for locating the dimples on a golf ball. One such means is the use of a plurality of great circles about the ball, which great circles form triangles which include the dimples to be used on the golf ball. Again, these balls provide for an equatorial line free of dimples so that they may be molded.

There is a constant striving for dimple configurations which provide the necessary aerodynamic symmetry and which still allow for the maximum surface coverage on the golf ball.

Accordingly, it is an object of the present invention to provide a golf ball having dimples on the surface which assume a unique symmetry about the surface of the ball so that the ball will fly equally well regardless of its position on the tee.

It is also an object of this invention to provide a method for locating dimples on the surface of a ball so as to achieve aerodynamic symmetry.

It is a further object of this invention to provide a modified octahedral dimple pattern using circular dimple groupings.

These and other objects of the invention will become obvious from the following description taken together with the drawings.

SUMMARY OF THE INVENTION

The present invention provides a golf ball having an octahedral pattern about its surface with four identical quadrants in each hemisphere. Each quadrant includes a circular area which fills the quadrant as completely as possible without crossing quadrant boundaries. A dimple is located at each pole. Each circular area is substantially filled with dimples and the remaining interstitial areas between the circular areas and the poles are substantially filled with dimples while leaving a dimple free equatorial line.

DETAILED DESCRIPTION OF THE INVENTION

Figure 1:
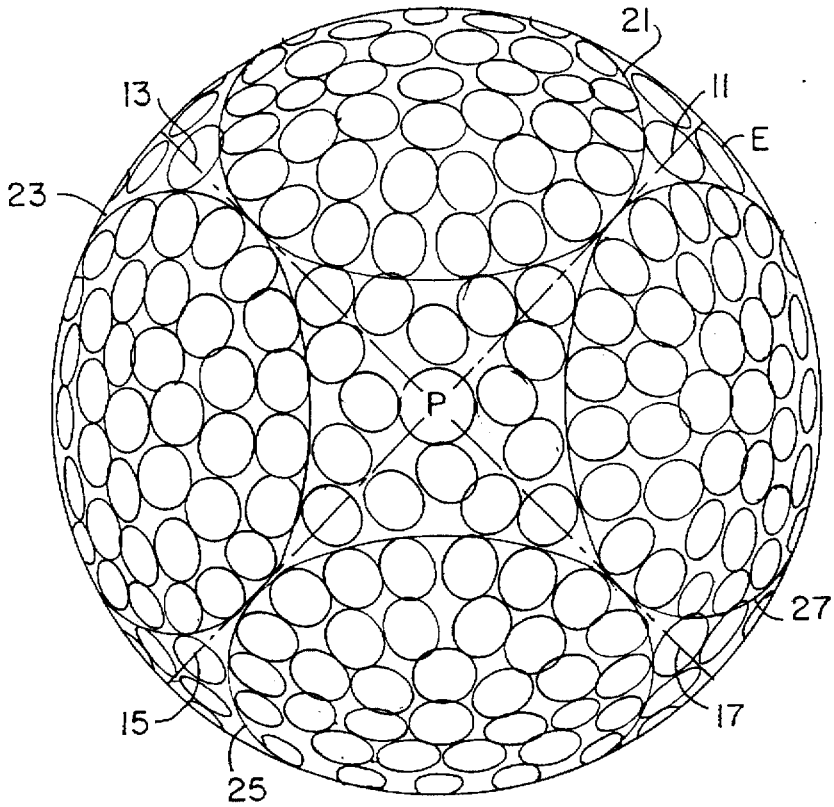
FIG. 1 is a polar view of a golf ball having a dimple pattern according to the present invention.

Referring to FIG. 1, there is shown a polar view of one embodiment of the present invention. The hemisphere illustrated is divided into four equal quadrants by dashed lines 11, 13, 15, and 17 extending from pole P to equator E. The quadrants contain imaginary circles 21, 23, 25 and 27. The opposed hemisphere of the ball contains identical quadrants and imaginary circles such that the resulting ball surface contains an octahedral pattern. Since both hemispheres are substantially identical, the description will be limited to one hemisphere for purposes of clarity.

As shown in FIG. 1, the imaginary circles fill the respective quadrants as completely as possible without crossing quadrant boundaries. The circles are substantially adjacent each other and, as shown in FIG. 2, are adjacent the dimple free equatorial line E.

Each of the circles are filled with dimples, and a dimple is provided at each pole P. The pattern of dimples is the same for each circle. The remaining surface of the ball between the circles, the pole dimple P and the equator E is filled with additional dimples.

Figure 2:
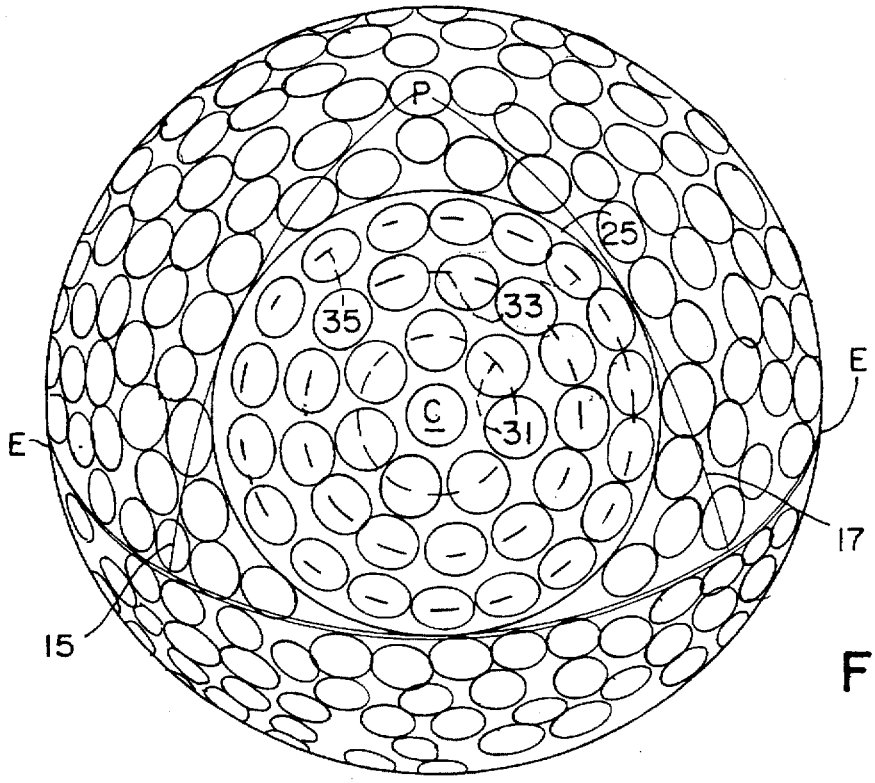
FIG. 2 is an off-equator view of the ball of FIG. 1.

FIG. 2 illustrates one quadrant in the preferred embodiment of the invention. Central dimple C is surrounded by dimples which form concentric circles 31, 33 and 35.

Figure 3:
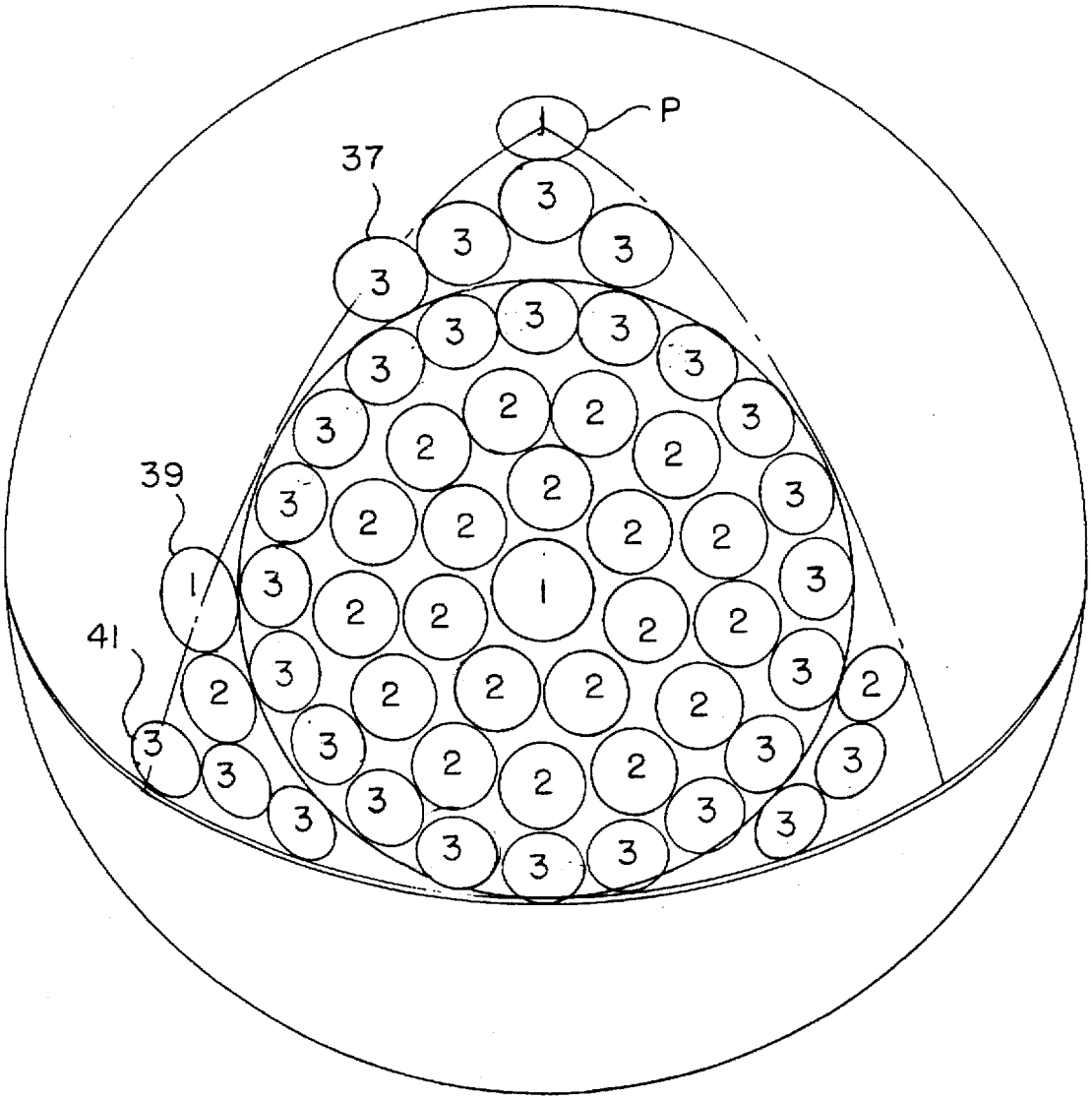
FIG. 3 is an off-equator view illustrating the dimple pattern of one octant of the ball of FIG. 1.

FIG. 3 illustrates the dimple pattern of one quadrant within the hemisphere as shown in FIG. 1. All four quadrants share a common polar dimple P.

In the preferred embodiment, each quadrant contains dimples having different diameters 1, 2 and 3. Dimples 1 have larger diameters than dimples 2 which have larger diameters than dimples 3. Each quadrant shares dimples 37, 39 and 41 in addition to polar dimple P.

In the preferred embodiment, the surface of the ball has a pattern which contains the following dimples:

| Dimple | Number of Dimples | Diameter |
|---|---|---|
| D1 | 18 | 0.165 in |
| D2 | 176 | 0.142 in |
| D3 | 224 | 0.137 in |

This results in a total of 418 dimples which covers 72.1% of the ball surface.

Figure 4A:
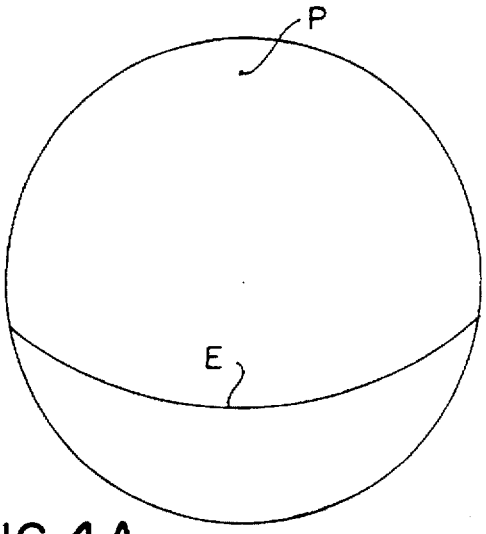
FIGS. 4A–4E illustrate the method for arranging dimples on a golf ball according to the invention.
Figure 4B:
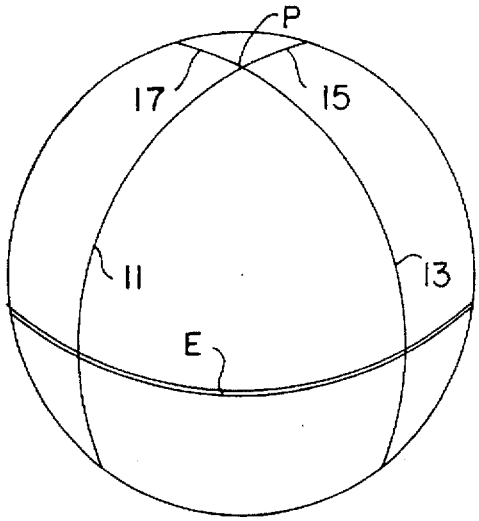
Figure 4C:
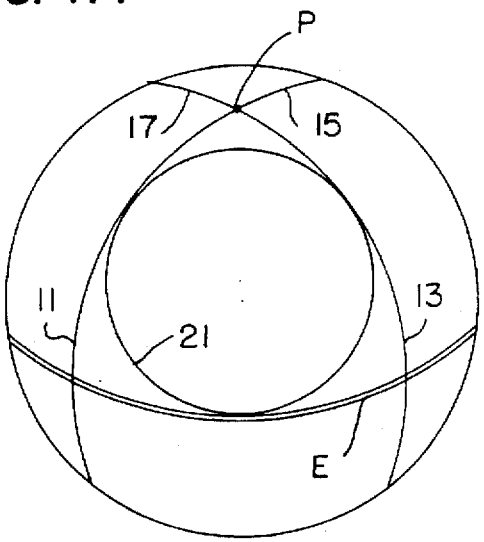
Figure 4D:
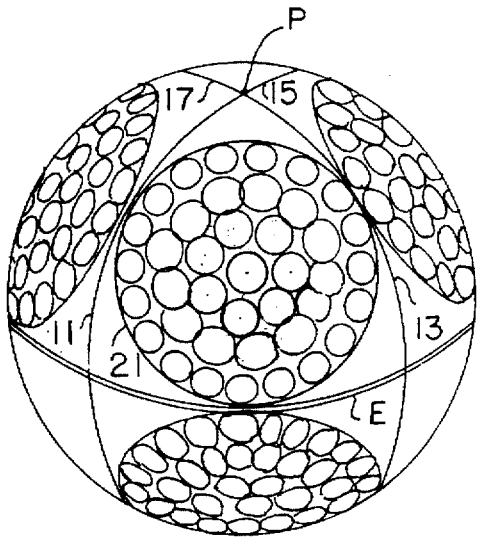
Figure 4E:
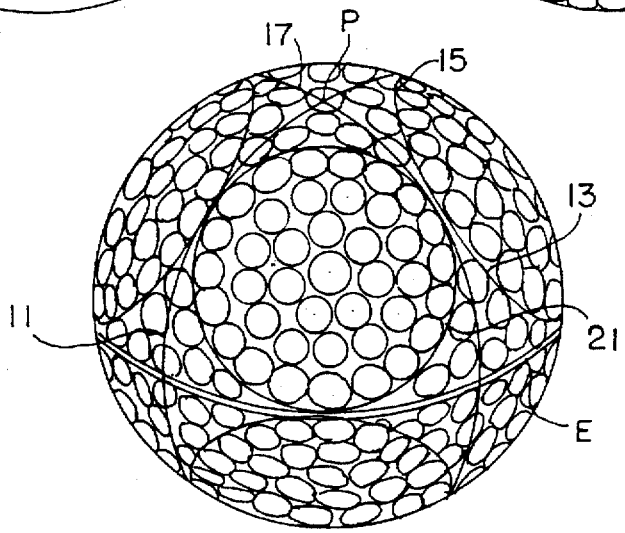

The method for arranging dimples on the surface of a golf ball will be described with reference to FIGS. 4A–4E. An equatorial line E is defined on the golf ball as shown in FIG. 4A. The line divides the ball into two hemispheres, each containing a pole P. Referring now to FIG. 4B, each hemisphere is divided into four equal quadrants by a plurality of imaginary lines 11, 13, 15, 17 extending from the pole to the equatorial line E. A circular area of maximum diameter is defined in each quadrant. One such circular area defined by a line 21 is shown in FIG. 4C. The circular area fills each quadrant as completely as possible without crossing the lines of the quadrant. Next, each circular area is filled with a first plurality of dimples as shown in FIG. 4D without any of the first plurality of dimples intersecting the lines which define the circular areas. The number of first dimples and the dimple pattern is substantially the same in each quadrant. Finally, the remaining area between the circular areas is filled with a second plurality of dimples as shown in FIG. 4E. No dimples are provided on the equatorial line E although some of the second plurality of dimples cross the circular area defining lines 21.

The above description and drawings are illustrative only since modification of the dimple size and patterns could be provided without departing from the present invention which is limited only by the scope of the following claims.

We claim:

1. A golf ball having a dimpled surface, comprising (a) a dimple-free equatorial line dividing said ball into two hemispheres each having a pole and substantially identical dimple patterns;

(b) a plurality of imaginary lines extending from said pole to said equatorial line in each hemisphere to divide each hemisphere into four equal quadrants;

(c) a line generally defining an imaginary circle of maximum diameter within each quadrant, said imaginary circles of said four quadrants being adjacent each other and adjacent said equatorial line and spaced from said pole;

(d) a first plurality of dimples forming a substantially identical dimple pattern within each of said imaginary circles without intersecting said circle defining lines; and (e) a second plurality of dimples arranged between said imaginary circles, said pole, and said equatorial line.

2. A golf ball as defined in claim 1, wherein a dimple is arranged at each pole.

3. A golf ball as defined in claim 2, wherein said first plurality of dimples includes a selected number of dimples arranged in a plurality of substantially concentric adjacent circles.

4. A golf ball as defined in claim 3, wherein said first plurality of dimples further includes a central dimple.

5. A golf ball as defined in claim 4, wherein said selected number of dimples are arranged in three substantially concentric adjacent circles.

6. A golf ball as defined in claim 5, wherein said surface contains 418 dimples.

7. A golf ball as defined in claim 6, wherein 18 dimples have a diameter D1, 176 dimples have a diameter D2, and 224 dimples have a diameter D3, where D1>D2>D3.

8. A method of forming a dimple pattern on the surface of a golf ball, comprising the steps of (a) dividing the surface into two hemispheres with respect to an equatorial line, each hemisphere containing a pole;

(b) dividing each hemisphere into four equal quadrants via a plurality of imaginary lines extending from the pole to the equatorial line;

(c) locating a line defining a generally circular area of maximum diameter within each quadrant, said circular areas being adjacent each other and adjacent said equatorial line and spaced from said pole;

(d) filling each of said circular areas with first dimples without intersecting a circular area defining line, the number of first dimples and the pattern formed by said first dimples being substantially the same in each circular area; and (e) filling the remaining area between said circular areas with second dimples, said equatorial line being dimple free.

9. A method as defined in claim 8, wherein each of said circular areas contains a central dimple and a plurality of dimples arranged in concentric rings about said central dimple.

* * * * *